US009821365B2

(12) United States Patent
Colosseo et al.

(10) Patent No.: US 9,821,365 B2
(45) Date of Patent: Nov. 21, 2017

(54) METHOD FOR MANUFACTURING A CAMSHAFT FOR AN INTERNAL COMBUSTION ENGINE BY EXPANDING A TUBULAR ELEMENT WITH A HIGH PRESSURE FLUID AND SIMULTANEOUSLY COMPRESSING THE TUBULAR ELEMENT AXIALLY

(71) Applicant: C.R.F. Societa Consortile per Azioni, Orbassano (Turin) (IT)

(72) Inventors: Marco Colosseo, Orbassano (IT); Daniele Bassan, Orbassano (IT)

(73) Assignee: C.R.F. Societa Consortile per Azioni, Orbassano (Turin) (IT)

( * ) Notice: Subject to any disclaimer, the term of this patent is extended or adjusted under 35 U.S.C. 154(b) by 453 days.

(21) Appl. No.: 14/599,665

(22) Filed: Jan. 19, 2015

(65) Prior Publication Data

US 2015/0231685 A1 Aug. 20, 2015

(30) Foreign Application Priority Data

Feb. 18, 2014 (EP) ..... 14155616

(51) Int. Cl.
*B21D 53/84* (2006.01)
*B21D 26/047* (2011.01)

(52) U.S. Cl.
CPC ..... *B21D 53/845* (2013.01); *B21D 26/047* (2013.01); *Y10T 29/49293* (2015.01)

(58) Field of Classification Search
CPC ..... B21D 53/845; B21D 26/047; Y10T 29/49293
See application file for complete search history.

(56) References Cited

U.S. PATENT DOCUMENTS 4,210,090 A * 7/1980 Stubbings ..... B21C 37/286 29/781
5,303,570 A * 4/1994 Kaiser ..... B21C 37/283 29/421.1

(Continued)

FOREIGN PATENT DOCUMENTS

DE 3616901 11/1986
WO 9746341 12/1977

OTHER PUBLICATIONS

European Search Report for International Application No. 14155616.7 dated Jun. 5, 2014, 4 pages.

*Primary Examiner* — Richard Chang
(74) *Attorney, Agent, or Firm* — RMCK Law Group, PLC

(57) ABSTRACT

In a method for manufacturing a camshaft for an internal combustion engine a metal tubular element is expanded within a mold with the aid of a fluid at high pressure fed into the tubular element and with a simultaneous axial compression of the tubular element. The cams of the camshaft are formed in subsequent steps, starting from intermediate cams and ending with end cams. In a first step of the method, the intermediate cams are formed in a first mold. In a subsequent step, the end cams are formed within auxiliary molds which surround, only throughout a predetermined length, end portions of the tubular element which project from the mold which surrounds the already formed intermediate cams. In this subsequent step, the tubular element is compressed axially by axially displacing two clamp members, which grip and surround completely, throughout a predetermined length, the end portions of the tubular element which project outwardly from the auxiliary molds.

7 Claims, 4 Drawing Sheets

(56) References Cited

U.S. PATENT DOCUMENTS 5,918,494 A * 7/1999 Kojima ..... B21D 17/025 72/58
5,927,119 A * 7/1999 Hamano ..... B21D 26/037 72/58
5,979,386 A * 11/1999 Swars ..... B21D 53/845 123/90.6
6,009,734 A * 1/2000 Augustin ..... B21D 17/025 72/58
6,105,227 A * 8/2000 Bota ..... B21C 37/104 29/33 K
6,105,409 A * 8/2000 Kojima ..... B21D 26/047 29/421.1
6,128,936 A * 10/2000 Yogo ..... B21D 26/041 29/421.1
6,154,944 A * 12/2000 Mason ..... B21D 26/033 29/33 D
6,237,382 B1 * 5/2001 Kojima ..... B21D 22/025 29/421.1
6,261,392 B1 * 7/2001 Sundgren ..... B21D 26/033 148/590
6,378,184 B1 * 4/2002 Bota ..... B21C 37/104 29/33 K
6,442,987 B1 * 9/2002 Worringer ..... B21D 26/033 72/58
6,530,252 B1 * 3/2003 Hashimoto ..... B21D 26/025 29/421.1
6,749,954 B2 * 6/2004 Toyooka ..... B21B 17/14 138/171
6,892,560 B2 * 5/2005 Hiramatsu ..... B21D 26/039 29/421.1
6,912,884 B2 * 7/2005 Gharib ..... B21D 26/043 72/58
7,024,897 B2 * 4/2006 Pfaffmann ..... B21D 26/033 148/520
7,266,982 B1 * 9/2007 Guza ..... B21D 26/02 29/421.1
7,269,986 B2 * 9/2007 Pfaffmann ..... B21D 26/033 72/342.94
7,328,510 B2 * 2/2008 Munoz ..... B21C 37/125 29/33 K
7,628,129 B2 * 12/2009 Takeshima ..... B21C 9/005 123/90.44
8,020,419 B2 * 9/2011 Ghiran ..... B21D 26/047 72/61
8,281,630 B2 * 10/2012 Mizumura ..... B21D 26/043 29/421.1
8,408,034 B2 * 4/2013 Ishihara ..... B21D 26/047 29/421.1
8,621,904 B2 * 1/2014 Mizumura ..... B21D 26/041 72/16.1
9,273,770 B2 * 3/2016 Echle ..... B23P 15/00
9,534,674 B2 * 1/2017 Binder ..... B21D 53/845
2003/0221514 A1 12/2003 Amborn
2006/0107716 A1 * 5/2006 Dykstra ..... A61F 13/15203 72/60

* cited by examiner

METHOD FOR MANUFACTURING A CAMSHAFT FOR AN INTERNAL COMBUSTION ENGINE BY EXPANDING A TUBULAR ELEMENT WITH A HIGH PRESSURE FLUID AND SIMULTANEOUSLY COMPRESSING THE TUBULAR ELEMENT AXIALLY

CROSS REFERENCE TO RELATED APPLICATIONS

This application claims priority to European Patent Application No. 14155616.7 filed on Feb. 18, 2014, the entire disclosure of which is incorporated herein by reference.

FIELD OF THE INVENTION

The present invention relates to methods for manufacturing camshafts for internal combustion engines, of the type in which a metal tubular element is expanded within a mould with the aid of a fluid at high pressure fed into the tubular element and by simultaneously compressing the tubular element axially.

In particular the invention relates to a method of the type in which the cams of the camshaft are formed in subsequent steps, starting from the intermediate cams to end with the cams at the ends of the camshaft.

A method of the above indicated type is disclosed for example in US 2003/0221514 A1. In the solution described in this document, the cams of the camshaft are formed by constantly feeding pressurized fluid into the tubular element and by simultaneously compressing the tubular element with the aid of punches axially pushed against the opposite ends of the tubular element. The cams are formed within corresponding cavities of the mould by heating locally and in sequence the different portions of the tubular element which must define the cams in the finished product. This solution does not ensure a precise and reliable control on the forming process of the various cams and is also relatively complicated and costly to be implemented.

OBJECT OF THE INVENTION

The object of the present invention is that of providing a method for manufacturing a camshaft for an internal combustion engine which is simpler and more reliable with respect to the known methods and through which in particular a camshaft which has the required dimensional and shape characteristics can be obtained with a good degree of precision and by simple and quick operations.

SUMMARY OF THE INVENTION

In view of achieving this object, the invention provides a method of the type indicated at the beginning of the present description, and further characterized in that:

in a first step of the method, the intermediate cams of the camshaft are formed within a first mould which surrounds only the intermediate portion of the tubular element, said mould having a cavity with portions having a shape and dimensions corresponding to those of the intermediate cams to be obtained, the remaining part of said cavity having a cylindrical shape and a diameter corresponding to the outer diameter of said tubular element, said tubular element being arranged within said first mould, with its ends portions which project from said first mould, during said first step of the method, fluid at high pressure is fed into the tubular element and the tubular element is simultaneously compressed axially by moving two clamp members axially towards each other, which clamp members grip and completely surround, throughout a predetermined length, the end portions of the tubular element which project outwardly from said first mould, in a subsequent step of the method, the end cams of the camshaft are formed within auxiliary moulds which surround, throughout a predetermined length, the end portions of the tubular element which project outwardly from the mould which surrounds the already formed intermediate cams, said auxiliary moulds have cavities with portions having a shape and dimensions corresponding to those of the end cams to be obtained and the remaining part of the cavities having a cylindrical shape and a diameter corresponding to the outer diameter of said tubular element, said auxiliary moulds are initially arranged axially spaced apart from the opposite ends of the mould which surrounds the already formed intermediate cams, said tubular element having its end portions which project beyond said auxiliary moulds, during said subsequent step of the method, fluid at high pressure is fed into the tubular element, while the tubular element is simultaneously compressed axially by moving two clamp members axially towards each other, which clamp members grip and completely surround, throughout a predetermined length, the end portions of the tubular element which project outwardly from said auxiliary moulds, during said subsequent step of the method, said clamp members are pushed axially until they come in contact against said auxiliary moulds, and then they are kept to be pushed axially until they move said auxiliary moulds in contact against the mould which surrounds the already formed intermediate cams, so as to form the end cams of the camshafts, while the cavity portions which are for forming the end cams are brought to a final axial position, in which said cavity portions for forming the end cams are at a proper axial distance from the already formed intermediate cams.

Due to the above indicated features, the method according to the invention enables the camshaft to be obtained simply and quickly, through subsequent forming of the intermediate cams and then of the end cams, while ensuring a precise control on dimensions and shape of the finished product.

The forming operation with the aid of fluid at high pressure can be carried out with or without heating, by a liquid fluid (such as water or oil) or with the aid of a gas. For example, nitrogen at a pressure between 400 and 800 bars can be used, at a temperature between 800° C. and 900° C. Alternatively, the forming operation can be carried out with water or oil at a pressure of 5000-6000 bars, at ambient temperature or at a temperature greater than ambient temperature.

For example, the tubular element can be made of hardened steel, such as boron steel 22MnB5 or 27MnCrB5.

The invention is also directed to the device for carrying out the method of the invention.

BRIEF DESCRIPTION OF THE FIGURES

Further features and advantages of the present invention will become apparent from the following description with reference to the annexed drawings, given purely by way of non-limiting example, in which.

DETAILED DESCRIPTION OF THE INVENTION

Figure 1:
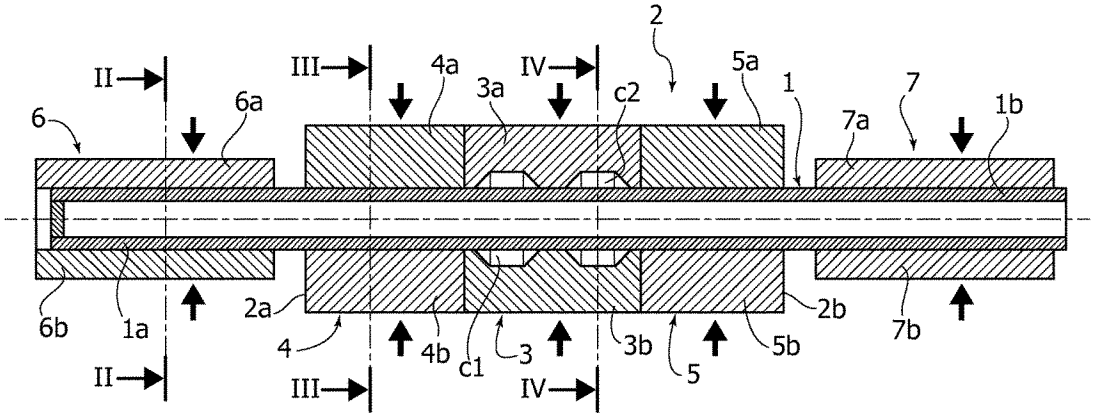
FIGS. 1 and 5 are diagrammatic and cross-sectional views which show the initial and final conditions of a first step of the method according to the invention.
Figure 2:
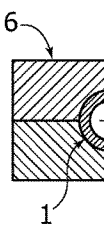
FIGS. 2-4 are cross-sectional views taken along lines II,III,IV of FIG. 1, FIG. 6, 7 are cross-sectional views which show the initial and final conditions of a second step of the method according to the invention.
Figure 3:
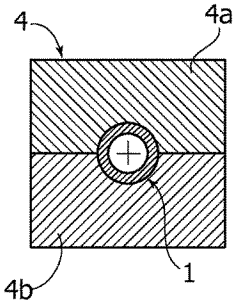
Figure 4:
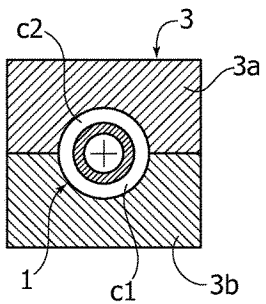

With reference to FIG. 1, reference number 1 generally designates a tubular element made for example of boron steel 22MnB5. In an actual embodiment, tubular element 1 had a length L=500 mm and inner and outer diameters d=27 mm and D=30 mm.

Figure 8:
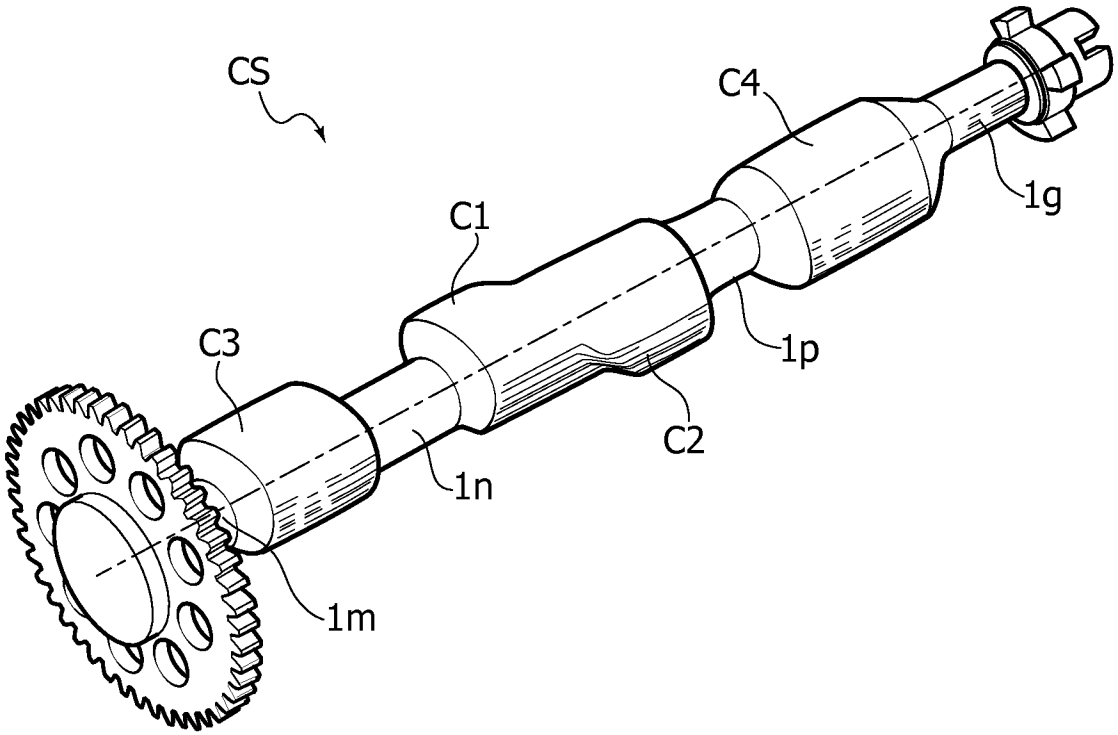
FIG. 8 shows an example of a camshaft which can be obtained with the method of the invention.

In the first step of the method shown in FIG. 1, the tubular element 1 is arranged within a mould 2 for forming the two intermediate cams of the camshaft, i.e. two cams C1, C2 which are located at the intermediate shaft portion in the finished camshaft CS (FIG. 8).

As shown in FIG. 1, in the initial step of the method the tubular element 1 is positioned with its central portion located inside mould 2 and its end portions 1*a*, 1*b*, which project outwardly from the opposite ends 2*a*, 2*b* of mould 2.

In the illustrated example, mould 2 is made of a central mould section 3 and two end mould sections 4, 5 arranged at the two sides of the central mould section 3. Mould sections 3, 4, 5 are each consisting of two half-moulds 3*a*, 3*b*; 4*a*, 4*b*; 5*a*, 5*b* which can be displaced between an opened condition (not shown) and a closed condition in which each pair of half-moulds clamps a corresponding portion of the tubular element 1 therebetween.

The present description and the annexed drawings do not include the details of construction of the press in which the above described moulds are positioned and the means for displacing each pair of half-moulds between their opened and closed conditions. These details of construction, taken alone, do not fall within the scope of the present invention and can be made in any known way. Moreover, the deletion of these details from the drawings renders the latter simpler and easier to understand.

Naturally, although the illustrated example has a mould 2 made of three mould sections 3, 4, 5, theoretically a single pair of half-moulds could be provided, incorporating the three mould sections 3, 4, 5.

In the closed condition of the half-moulds 3*a*, 3*b*, 4*a*, 4*b*, 5*a*, 5*b*, mould 2 defines a forming cavity with cavity portions c1, c2 having a shape and dimensions corresponding to those of the intermediate cams C1, C2 to be formed. For the remaining part, the forming cavity is a cylindrical cavity with a diameter corresponding to the outer diameter of the tubular element 1. In the case of the illustrated example, the cavity portions c1, c2 are defined by the half-moulds 3*a*, 3*b* of the central mould section 3, whereas the half-mould of the end mould sections 4, 5 define cylindrical cavities with a diameter corresponding to the outer diameter of the tubular element. Between the two cavity portions c1, c2, also the two half-moulds of the central mould section 3 define a cylindrical cavity with a diameter corresponding to the outer diameter of the tubular element 1.

In the closed condition of half-moulds 3*a*, 3*b*, 4*a*, 4*b*, 5*a*, 5*b* which constitute mould 2, these half-moulds surround completely and are clamped in contact with the intermediate portion of the tubular element 1, except for the portions thereof located at the cavity portions c1, c2 which are to form the intermediate cams C1, C2 of the camshaft.

The half-moulds of mould 2 are clamped against the tubular element 1 with a force which may be for example of 500 tons, approximately.

During the forming step of the intermediate cams C1, C2 shown in FIG. 1, pressurized fluid (such as water at 5000 bars) is fed into the tubular element 1.

The details of construction of the means for feeding the pressurized fluid into the tubular element are not described nor shown herein, since they do not fall, taken alone, within the scope of the present invention and also because they can be made in any known way, the representation in the annexed drawings being evidently purely diagrammatic. It is believed that the deletion of these details from the drawings renders the latter quicker and easier to understand.

During said first step of the method according to the invention, the tubular element 1 is compressed axially while the pressurized fluid is simultaneously fed into the tubular element.

In the case of the invention, the axial compression of the tubular element 1 is obtained by providing two clamp members 6, 7 which grip and surround completely, throughout a predetermined length, the end portions 1*a*, 1*b* of the tubular element 1 which project outwardly from mould 2. Clamp members 6, 7 are each consisting of two jaws 6*a*, 6*b*; 7*a*, 7*b* which define therebetween a cylindrical cavity having a diameter corresponding to the outer diameter of the tubular element 1. The jaws of the clamp members 6, 7 are clamped against the end portions 1*a*, 1*b* of the tubular element 1 by a force for example of 500 tons approximately. As shown in FIG. 1, in the initial step of the method, clamp members 6, 7 are spaced from the opposite ends 2*a*, 2*b* of mould 2. According to the invention, the clamp members 6, 7 are displaced axially against each other (i.e. along the direction of the axis of tubular element 1), until they come in contact with the opposite ends 2*a*, 2*b* of mould 2, during the step for forming cams C1, C2, while pressurized water is fed into tubular element 1.

Referring to FIG. 1, which is purely diagrammatic, pressurized water is fed (with the aid of means of any known type) from the right end of tubular element 1, while the left end of tubular element 1 is closed, so that the pressurized water causes deformation of the wall of the tubular element 1 within portions c1, c2 of the forming cavity, until the wall of the tubular element is pressed against the surface of said cavity portions c1, c2, thus forming two cams C1, C2. The displacement of material during this step is favoured by the axial compression of tubular element 1 which, as shown, takes place due to the action of clamp members 6, 7. These clamp members engage the end portions 1*a*, 1*b* of the tubular element 1 throughout a predetermined axial length and therefore they ensure that these end portions are kept at the initial dimension of the tubular element during this first step of the method. The same applies to the portions of the tubular element which are located within mould 2 but out of the two cavity portions c1, c2.

Figure 5:
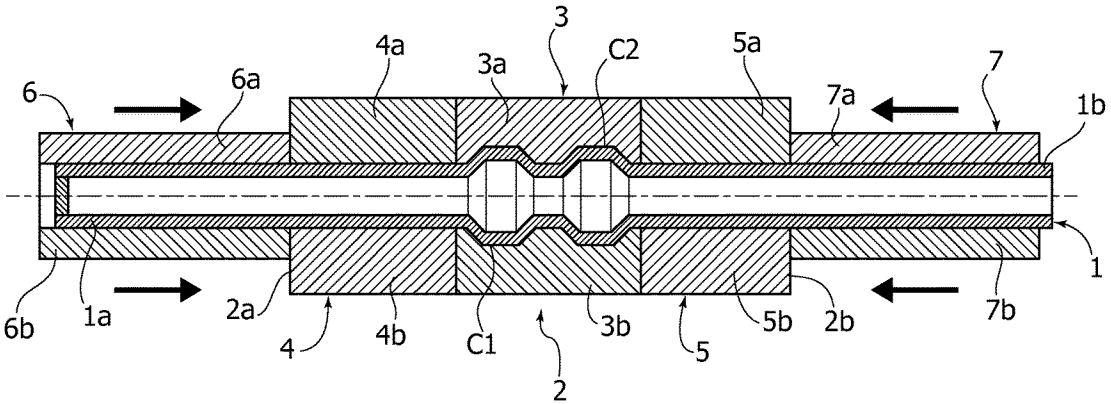

Due to the above described measures, the first step of the method according to the invention brings to forming a blank product having only the two intermediate cams C1, C2 as shown in FIG. 5.

Figure 6:
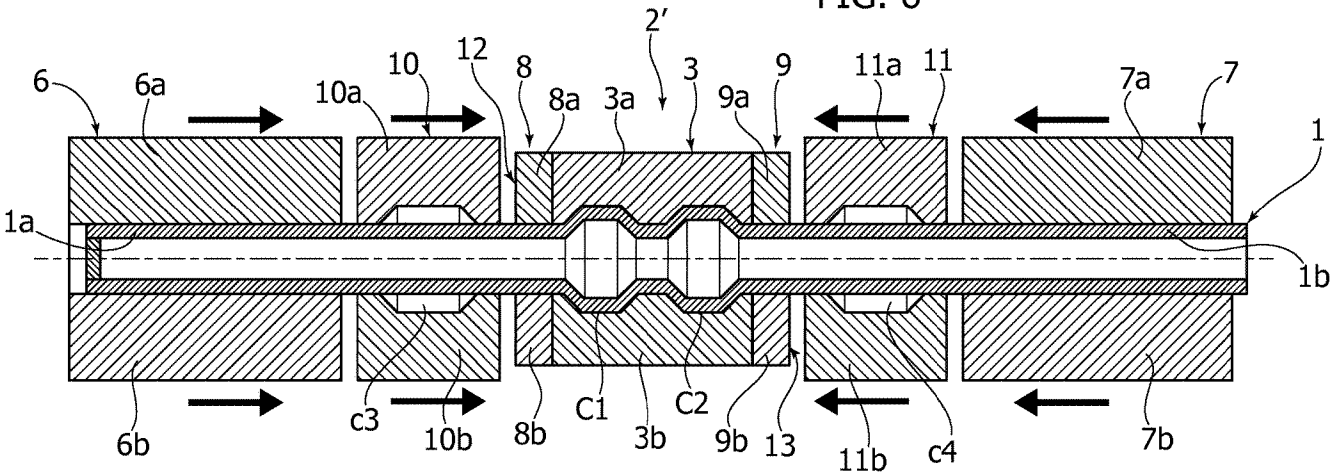
Figure 7:
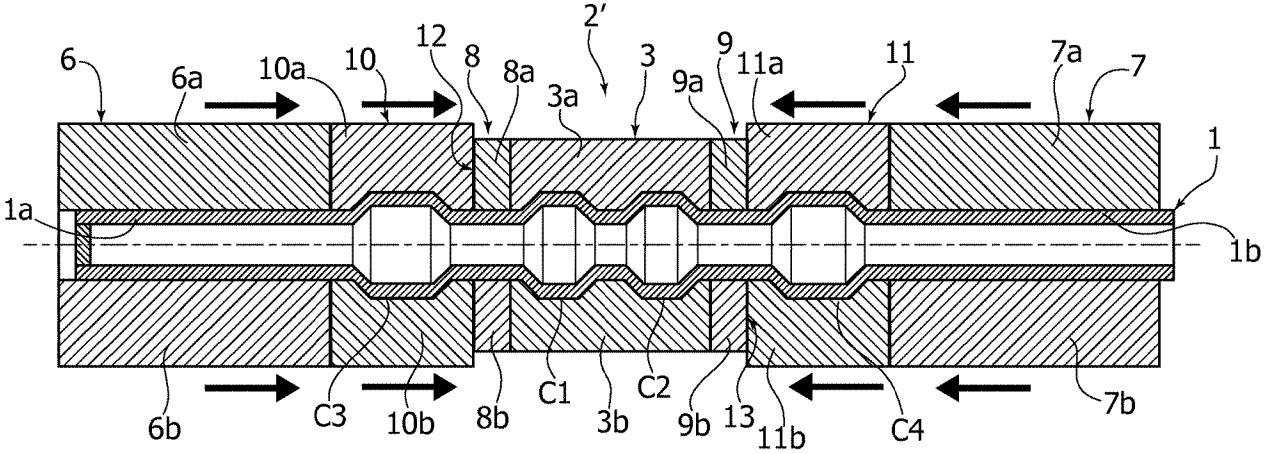

FIGS. 6, 7 show the second step of the method according to the invention, which is required for obtaining the end cams C3, C4 of the camshaft (see FIG. 8).

In order to carry out the second step of the method, the two intermediate cams C1, C2 which have been already obtained are kept within a mould 2' having a cavity copying the shape of these intermediate cams. In the case of the illustrated example, this mould 2' is made of the same central section 3 of mould 2 which has been used in the first step, completed with two end mould sections 8, 9 which are arranged in replacement of the two end mould sections 4, 5 of FIGS. 1, 5. The central mould section 3 and the end mould sections 8, 9 are each made of two half-moulds 3*a*, 3*b*; 8*a*, 8*b*; 9*a*, 9*b*. These half-moulds are pressed against the intermediate portion of tubular element 1, during the second step of the method according to the invention, by a force for example of 500 tons approximately. The replacement of mould sections 4, 5 with mould sections 8, 9 is merely due to the need of adopting mould sections having a lower axial dimension. However, the solution shown herein constitutes only an exemplary embodiment of the invention, while it is clearly evident that, for example, in the case of FIG. 6, in place of mould sections 3, 8, 9 a single mould section integrating the mould sections 3, 8, 9 could be used, which single mould section would be formed by two half-moulds clamped around the tubular element 1.

In the second step of the method according to the invention, two auxiliary moulds 10, 11 are further provided which surround, throughout a predetermined length, the end portions of the tubular element 1 which project outwardly from the mould defined by sections 3, 8, 9. The auxiliary moulds 10, 11 have forming cavities with portions c3, c4 having dimensions and shape corresponding to those of the end cams C3, C4 of the camshaft CS (see FIG. 8). The remaining parts of the cavities of auxiliary moulds 10, 11 (in the closed condition of these moulds) have a cylindrical shape and a diameter corresponding to the outer diameter of the tubular element 1, so that in the closed condition in which the half-moulds 10*a*, 10*b*, 11*a*, 11*b* are pressed against each other, said auxiliary moulds 10, 11 slidably engage the surface of the tubular element 1 and can be axially moved with respect thereto.

The auxiliary moulds 10, 11 are initially arranged axially spaced apart from the opposite ends 12, 13 of the mould which surrounds the already formed intermediate cams C1, C2 (which mould is constituted by the mould sections 3, 8, 9 in the illustrated example). The tubular element 1 has its end portions 1*a*, 1*b* which project beyond the auxiliary moulds 10, 11.

During the subsequent step of the method, fluid at high pressure is fed into the tubular element 1 and the tubular element 1 is simultaneously compressed axially by displacing the two clamp members 6, 7 axially towards each other, which clamp members are those which have been already described as being used in the initial step of the method. The two clamp members 6, 7, each consisting of the jaws 6*a*,6*b* and 7*a*, 7*b* as already indicated above, a grip and completely surround, through a predetermined length, the end portions 1*a*, 1*b* of the tubular element 1 which project outwardly from the auxiliary moulds 10, 11.

During this final step of the method, the clamp members 6, 7 start from a position axially spaced apart with respect to the auxiliary moulds 10, 11. The clamp members 6, 7 are pushed axially until they come in contact against the auxiliary moulds 10, 11 and then are kept to be pushed axially towards each other, until they move the auxiliary moulds 10, 11 against of the central mould which surrounds the intermediate cams C1, C2. In this step of the method, therefore the auxiliary moulds 10,11 are displaced by a length corresponding to the initial distance between the auxiliary moulds 10, 11 and the opposite ends 12, 13 of the central mould, whereas the clamp members 6, 7 are displaced by an axial length corresponding to the sum of the two spacings shown in FIG. 6, that is the initial distance between the auxiliary moulds 10, 11 and the opposite surfaces 12, 13 of the central mould, and the axial distance between each clamp member 6, 7 and the auxiliary mould 10, 11 which is adjacent thereto.

Therefore, in this step of the method, the portions of the tubular element 1 which are to form the end cams C3, C4 are expanded by the pressurized fluid fed into the tubular element, while the required flow of material is ensured by the axial compression of the tubular element 1. The end cams C3, C4 are thus formed while the forming cavities c3, c4 are progressively brought to the final positions in which they are at the proper distance from the intermediate cams C1, C2 which have been already formed. During this step, both the clamp members 6, 7 and also the end mould sections 8, 9 ensure that the portions of the camshaft adjacent to the cams (designated by 1*m*, 1*n*, 1*p*, 1*q* in FIG. 8) are kept to the proper dimension, corresponding to the outer diameter of the starting tubular element 1.

Also with reference to the second step of the method which have been described above, the details of constructions are not given relating to the press for use of the moulds which have been shown herein only diagrammatically, since they do not fall, taken alone, within the scope of the present invention and also because they can be implemented in any known way. The same applies to the means which are used for pushing the clamp members 6, 7 axially towards each other.

In the case of the embodiment shown herein, the cavity portions c1, c2, c3, c4 for forming cams C1, C2, C3, C4 are shaped so that each cam is formed with an axially intermediate portion whose surface has the required cam profile and two opposite end portions which are tapered progressively towards a confluence on the outer cylindrical surface of the shaft, from which the cams project. This shape is different with respect to that of conventional camshafts, in which each cam has two opposite end faces which are planar and orthogonal to the shaft axis. In this manner, proper operation of the camshaft is not jeopardized and at the same time an easier deformation of the wall of the tubular element 1 during the camshaft forming operation is possible.

Naturally, while the principle of the invention remains the same, the details of construction and the embodiments may widely vary with respect to what has been described and illustrated purely by way of example, without departing from the scope of the present invention.

What is claimed is:

1. A method for manufacturing a camshaft for an internal combustion engine, wherein a metal tubular element is expanded by feeding a fluid at high pressure into the tubular element while simultaneously compressing the tubular element axially, the camshaft, once formed, having cams that include two end cams which are closest to two opposite ends of the camshaft and intermediate cams which are located between the two end cams at intermediate portions of the camshaft, the method comprising:

forming, in a first step, the intermediate cams of the camshaft within a first mould which surrounds only an intermediate portion of the tubular element, said first mould having a cavity with portions having a shape and dimensions corresponding to those of the intermediate cams to be formed and a remaining part of said cavity having a cylindrical shape and a diameter corresponding to an outer diameter of said tubular element, said tubular element being arranged within said first mould with end portions of the tubular element projecting from said first mould, wherein forming the intermediate cams in the first step includes:

feeding fluid at high pressure into the tubular element, while the tubular element is simultaneously compressed axially by displacing two clamp members axially towards each other, which clamp members grip and completely surround, throughout a predetermined length, the end portions of the tubular element which project outwardly from said first mould, subsequently forming, in a second step, the two end cams within auxiliary moulds which surround, throughout a predetermined length, the end portions of the tubular element which project outwardly from a second mould which surrounds the already formed intermediate cams, said auxiliary moulds having cavities with portions having a shape and dimensions corresponding to those of the two end cams to be formed and a remaining part of said cavities of said auxiliary moulds having a cylindrical shape and a diameter corresponding to the outer diameter of said tubular element, said auxiliary moulds being initially located axially spaced apart from opposite ends of the second mould which surrounds the intermediate cams which have been already formed, said tubular element end portions projecting beyond said auxiliary moulds, wherein forming the two end cams in the second step includes:

feeding fluid at high pressure into the tubular element, while the tubular element is simultaneously compressed axially by displacing the two clamp members axially towards each other, which clamp members grip and completely surround, throughout a predetermined length, the end portions of the tubular element which project outwardly from said auxiliary moulds, and pushing said clamp members axially until they come in contact against said auxiliary moulds and then they are kept to be pushed axially until moving said auxiliary moulds in contact against the second mould which surrounds the already formed intermediate cams, so as to form the two end cams of the camshaft, while the cavities for forming the two end cams are brought to a final axial position, in which said cavity portions of said auxiliary moulds for forming the two end cams are located at a proper axial distance with respect to the intermediate cams which have been formed already.

2. The method according to claim 1, wherein:

said first mould comprises a central mould section defining the cavity having said portions for forming the intermediate cams of the camshaft, and a first set of two end mould sections arranged at opposed sides of the central mould section and defining cylindrical cavities having a diameter corresponding to the outer diameter of the tubular element, and wherein said second step of the method is carried-out by the second mould which includes the central mould section and a second set of two end mould sections having an axial dimension lower than that of the first set of end mould sections used in the first method step.

3. The method according to claim 1, wherein said clamp members each comprise two jaws which, in a closed condition thereof, define a cylindrical cavity having a diameter corresponding to the outer diameter of the tubular element.

4. The method according to claim 1, wherein each of said auxiliary moulds comprises two half-moulds which, in a closed condition, are slidably engaged over the outer surface of the tubular element.

5. The method according to claim 1, wherein the cavity portions for forming the intermediate cams and the two end cams are shaped so that each cam is formed with an axially intermediate portion whose surface has a required cam profile and two opposite end portions which taper progressively towards a confluence on a cylindrical outer surface of a shaft from which the cams project.

6. A device for manufacturing a camshaft for an internal combustion engine by expanding a metal tubular element by feeding a fluid at high pressure into the tubular element while simultaneously compressing the tubular element axially, the camshaft, once formed, having cams that include two end cams which are closest to two opposite ends of the camshaft and intermediate cams which are located between the two end cams at intermediate portions of the camshaft, said device being provided for forming the cams in subsequent steps, starting from the intermediate cams and ending with the two end cams, said device comprising:

a first mould for forming the intermediate cams in a first step of the operation for forming the camshaft, said first mould being provided for surrounding only an intermediate portion of the tubular element and having a cavity with portions having a shape and dimensions corresponding to those of the intermediate cams to be formed and a remaining part of said cavity having a cylindrical shape with a diameter corresponding to an outer diameter of said tubular element, a pair of clamp members, adapted to grip and completely surround, for a predetermined length, end portions of the tubular element which project outwardly from said first mould, said clamp members being axially movable towards each other for compressing the tubular element axially while a fluid at high pressure is fed into the tubular element, so as to form the intermediate cams of the camshaft, a pair of auxiliary moulds provided for surrounding, throughout a predetermined length, the end portions of the tubular element which project outwardly from a second mould which surrounds the intermediate cams after the intermediate cams have been formed, said auxiliary moulds having cavities with portions having a shape and dimensions corresponding to those of the two end cams to be formed and a remaining part of said cavities of said auxiliary moulds having a cylindrical shape and a diameter corresponding to the outer diameter of said tubular element, said auxiliary moulds being initially arranged axially spaced apart from opposed ends of the second mould which surrounds the intermediate cams which have been already formed, and said auxiliary moulds being slidably engaged, in their closed condition, on the end portions of the tubular element, said clamp members gripping and completely surrounding, throughout the predetermined length, the end portions of the tubular element which project outwardly from said auxiliary moulds and said clamp members being axially displaceable towards each other, so as to compress the tubular element axially, while a fluid at high pressure is fed into the tubular element, so that said auxiliary moulds are pushed by said clamp members so as to slide on the tubular element until they come in contact against said second mould which surrounds the already formed intermediate cams, until the cavities for forming the two end cams are brought to a final axial position, in which said cavity portions of said auxiliary moulds for forming said two end cams are located at a proper axial distance with respect to the already formed intermediate cams.

7. The device according to claim 6, wherein the cavity portions for forming the intermediate cams and two end cams are shaped so that each cam is formed with an axially intermediate portion whose surface has a desired cam profile and two opposite end portions which taper progressively towards a confluence on an outer cylindrical surface of a shaft from which the cams project.

* * * * *